United States Patent [19]

Miller et al.

[11] 4,166,448

[45] Sep. 4, 1979

[54] VENTILATION SYSTEM

[76] Inventors: Gerald K. Miller, 2909 Windsor Forest Dr., Louisville, Ky. 40272; William G. Wooden, 6020 Chenoweth Dr., Louisville, Ky. 40299

[21] Appl. No.: 846,404

[22] Filed: Oct. 28, 1977

[51] Int. Cl.[2] ..... F24C 15/20

[52] U.S. Cl. ..... 126/299 D

[58] Field of Search ..... 126/299 D, 299 R, 299 E; 98/115 K; 55/DIG. 36

[56] References Cited

U.S. PATENT DOCUMENTS

| | | | |
|---|---|---|---|
| 3,292,525 | 12/1966 | Jensen | 126/299 D |
| 3,411,428 | 11/1968 | Ahlrich | 126/299 D |
| 3,513,766 | 5/1970 | Ahlrich | 126/299 D |
| 3,625,135 | 12/1971 | Carlson | 126/299 D |
| 3,664,255 | 5/1972 | Kuechler | 126/299 D |
| 3,690,245 | 9/1972 | Ferlise | 126/299 D |
| 3,766,906 | 10/1973 | Jenn | 126/299 R |
| 3,800,689 | 4/1974 | Brown | 126/299 D |
| 4,085,736 | 4/1978 | Kuechler | 126/299 D |
| 4,089,327 | 5/1978 | Welsh | 126/299 D |

*Primary Examiner*—Nile C. Byers, Jr.

*Attorney, Agent, or Firm*—Wm. R. Price

[57] ABSTRACT

A ventilation system for removing fumes in the space above a cooking surface includes a hood located above the cooking surface which forms an entrainment chamber between the hood and the cooking surface, an air intake means having a blower which introduces outside air into the entrainment chamber and exhaust means in operative relation with the hood and including a filter member through which the air and the cooking fumes are passed to filter out the grease and to exhaust the filtered air and gasses into the atmosphere. The improvement is in the provision of an intake blower and an exhaust blower and additionally, an air spreading and diffusion means for forming an air pattern in the entrainment chamber corresponding to the planar area of the cooking surface. The diffused inlet gasses thus mix with the heated fumes and gasses from the cooking surface and therefore eliminates the need to pretemper the air entering the entrainment chamber. The provision of the air spreading and diffusion means in the top of the hood eliminates double walled hood construction with the pretempering chamber and can eliminate energy requirements by as much as 80%.

10 Claims, 6 Drawing Figures

VENTILATION SYSTEM

BACKGROUND OF THE INVENTION

1. Field of the Invention

This invention relates to ventilating systems utilizing hoods for removing grease and smoke from the spaces above cooking surfaces, particularly in restaurants.

2. Description of the Prior Art

There has been much activity in the field of ventilating systems and particularly in the field of hoods for filtering grease and smoke in restaurants in the past several years. Most of the prior art systems have utilized blowers for both the exhaust and the inlet. However, due to the fact that air is introduced from the outside, it has been necessary in most instances to preheat the incoming air so as not to unduly lower the temperature of the restaurant. Thus, for example, with most ventilating hood systems used in restaurants the prior art has utilized a so called perimeter supply plenum so that a laminar flow of air is introduced around the perimeter of the hood. In some instances, the laminar flow of air is only in the front of the hood, which nevertheless, creates some discomfort for the cook standing directly below the flow of frigid air from the outside. Thus, it has been necessary in most instances to pretemper the cold air coming into the entrainment chamber defined by the hood. One approach to lower the heating bill for restaurants has been proposed by Lester H. Brown in U.S. Patent 3,800,689. Brown proposes a by-pass duct extending from the exhaust blower outlet to the intake blower inlet and a damper responsive to temperatures sensed in the intake duct to pretemper the inlet air. Kuechler in U.S. Pat. Nos., 3,943,836 and 3,952,640 proposed a liner for the hood which was substantially curved to produce a vortex action within the entrainment chamber and which directed the inlet air and gas fumes from the cooking surface directly into the filter media and out through the exhaust. Many other proposals have been made but all have dictated the use of an intake plenum and in many cases even accessory heating elements for heating the intake air.

SUMMARY OF THE INVENTION

According to our invention, the perimeter supply plenum is eliminated. The present invention employs an intake blower and an exhaust blower. However, the intake blower blows air into a plenum directly above the roof of the hood. This intake plenum goes through a diffusion and air spreading means to equalize the volume of air delivered from said air intake means into the entrainment chamber formed by the hood. This air is thus spread and diffused across the horizontal plane of said entrainment chamber to correspond generally to the planar surface of the cooking area. The cold inlet air therefore mixes with the hot fumes and gasses from the cooking surface and thus eliminates the need for pretempering the inlet air and additionally eliminates the need for a perimeter supply plenum. This air is then exhausted through a filter media and out through the exhaust duct by means of the exhaust fan. The invention is made possible by balancing the static pressure of the inlet means and the exhaust means. A velocity damper is installed in the inlet supply duct to regulate the static pressure in the system. The static pressure is monitored by provision of a pressure sensor in the intake means and a pressure sensor in the exhaust means which sensors are interconnected electrically with the exhaust and intake fans and with indicating means in the form of indicator lights.

BRIEF DESCRIPTION OF THE DRAWINGS

Referring now to the drawings.

DESCRIPTION OF THE PREFERRED EMBODIMENT

Referring now to the drawings

Figure 1:
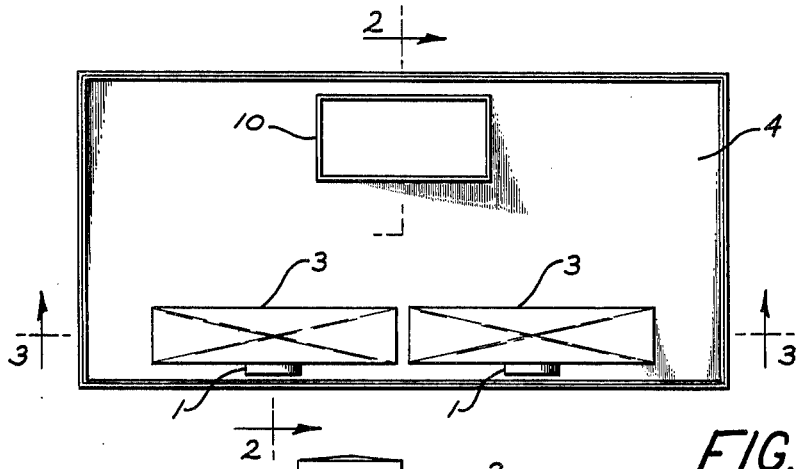
FIG. 1 is a plan view showing the hood of this invention and the plenum connections.
Figure 2:
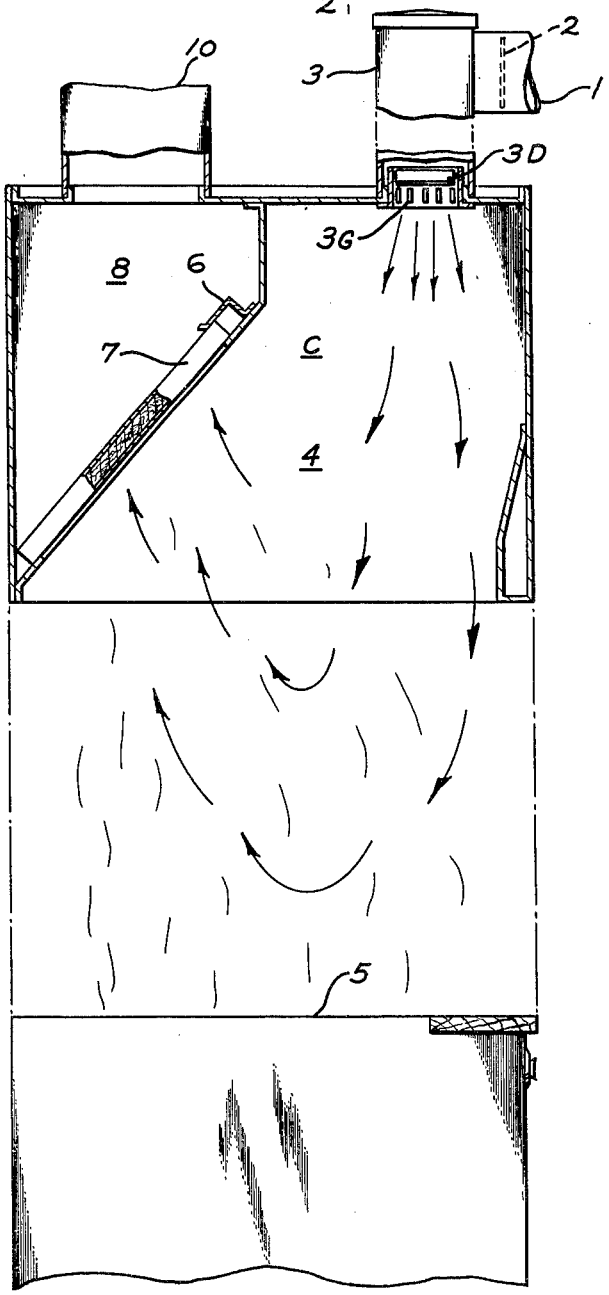
FIG. 2 is a sectional view taken along lines 2—2 illustrating the arrangement of the hood system over the cooking surface and the arrangement of the air spreading and diffusion means relative to the intake plenum and the relation of the filter unit relative to the exhaust duct.
Figure 3:
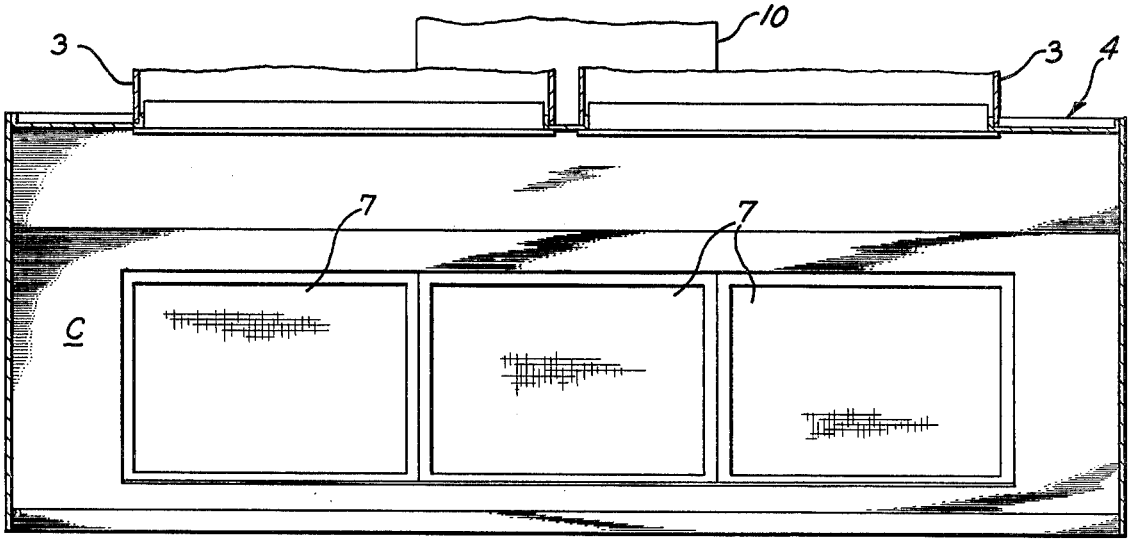
FIG. 3 is a sectional view taken along lines 3—3 of FIG. 1 illustrating the relation of the intake plenum to the air spreading and diffusion means and the relation thereto of the hood to the filter opening of the exhaust means.
Figure 3A:
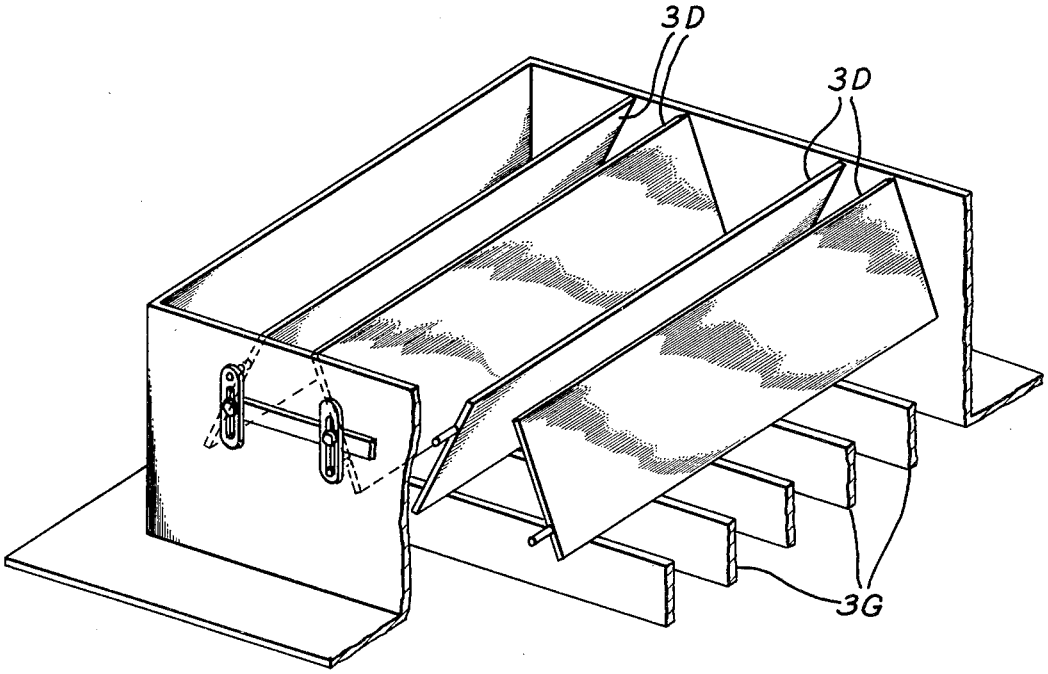
FIG. 3A is an exploded view of the diffusion damper and the diffusion grill of the air spreading and diffusion means illustrating the diverging vanes of the diffusion damper and the vertical vanes of the diffusion grill.

The air intake means are represented by the supply duct 1 and the air supply plenum 3. As is shown in the drawings the supply duct 1 is interconnected to the supply fan (not shown) on the roof of the building. Supply plenum 3 is in communication with the air spreading and diffusion means which includes the diffusion grill 3G and the diffusion damper 3D. FIG. 3A is an enlarged section of FIG. 3, illustrating the diverging vanes of the diffusion damper 3D and the vertical vanes of the diffusion grill 3G. The complementary action of the diffusion damper and diffusion grill is to spread the air into an air pattern which roughly corresponds with the rectangular area of the cooking surface 5. Thus the air pattern emerging from the spreader damper 3D and the diffusion grill 3G roughly fills the entrainment chamber C between the hood 4 and the cooking surface 5. The hood of course is held in place by means of the hood frame 4F and the entrainment chamber serves as a diffusion area and mixing means for the hot gasses and fumes coming from the cooking surface 5 and the cold air blown in through the supply air plenum 3. As will be noted, the rear of the hood member is diagonally situated and contains a filter frame 6 in which a media filter 7 is mounted. Thus the mixed gasses, including the cold air inlet gasses and the hot fumes from the cooking surface 5, are exhausted through the media filter 7 into exhaust chamber 8 and out through exhaust duct 10 through the exhaust fan on the roof (not shown).

It should be noted that with this construction the perimeter air inlet plenum is eliminated. The air from the roof is not pretempered but is diffused and mixed with the hot gasses in the entrainment chamber C thus providing a comfortable working area for the fry cook in the front of the damper of the hood, without a waste of energy. Our studies have shown that the energy requirements can be reduced as much as 80% in cold weather by the use of this system which has the further advantage of being cheaper initially to install. These savings are made possible by the balancing of the static pressure in the entire system. Thus the static pressure in the intake portion of the system is balanced with the static pressure of the exhaust duct and as a consequence the air pattern formed over the cooking surface 5 is possible without pretempering of the inlet air. By this system 80% of the air flow comes from the supply system and very little is drawn out from the heated air of the restaurant, (or the cooled air of the restaurant, depending upon the season) and thus eliminates the tremendous heat loss which has been experienced in restaurants with large ventilating grease hoods.

Figure 4:
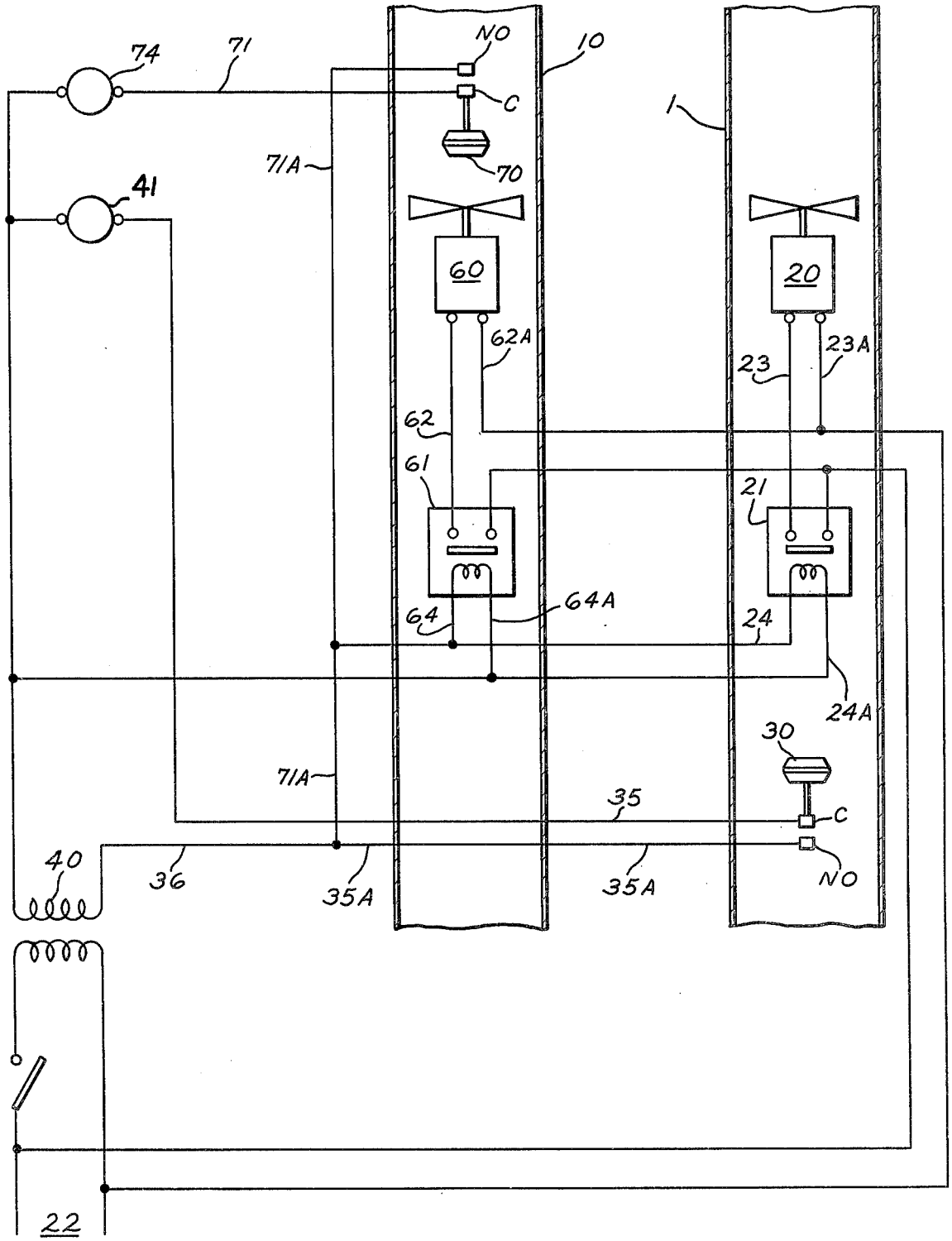
FIG. 4 is an electrical diagram of the control system illustrating the relationship of the pressure sensors to the fans and to the indicator lights.

Referring now to FIG. 4. The supply fan motor 20 is connected by the fan relay 21 to the power source 22. Line 23 runs through the relay 21. Line 23A indicates the neutral line completing the 110 volt circuit to the fan motor 20. Control power lines 24 and 24A energize the supply fan relay 21. The pressure sensor 30 contains a common terminal C, a normally open terminal NO. Line 35 running from sensor 30 controls the indicator light 41 on the panel while line 35A is connected to line 36 which runs to transformer 40.

Figure 5:
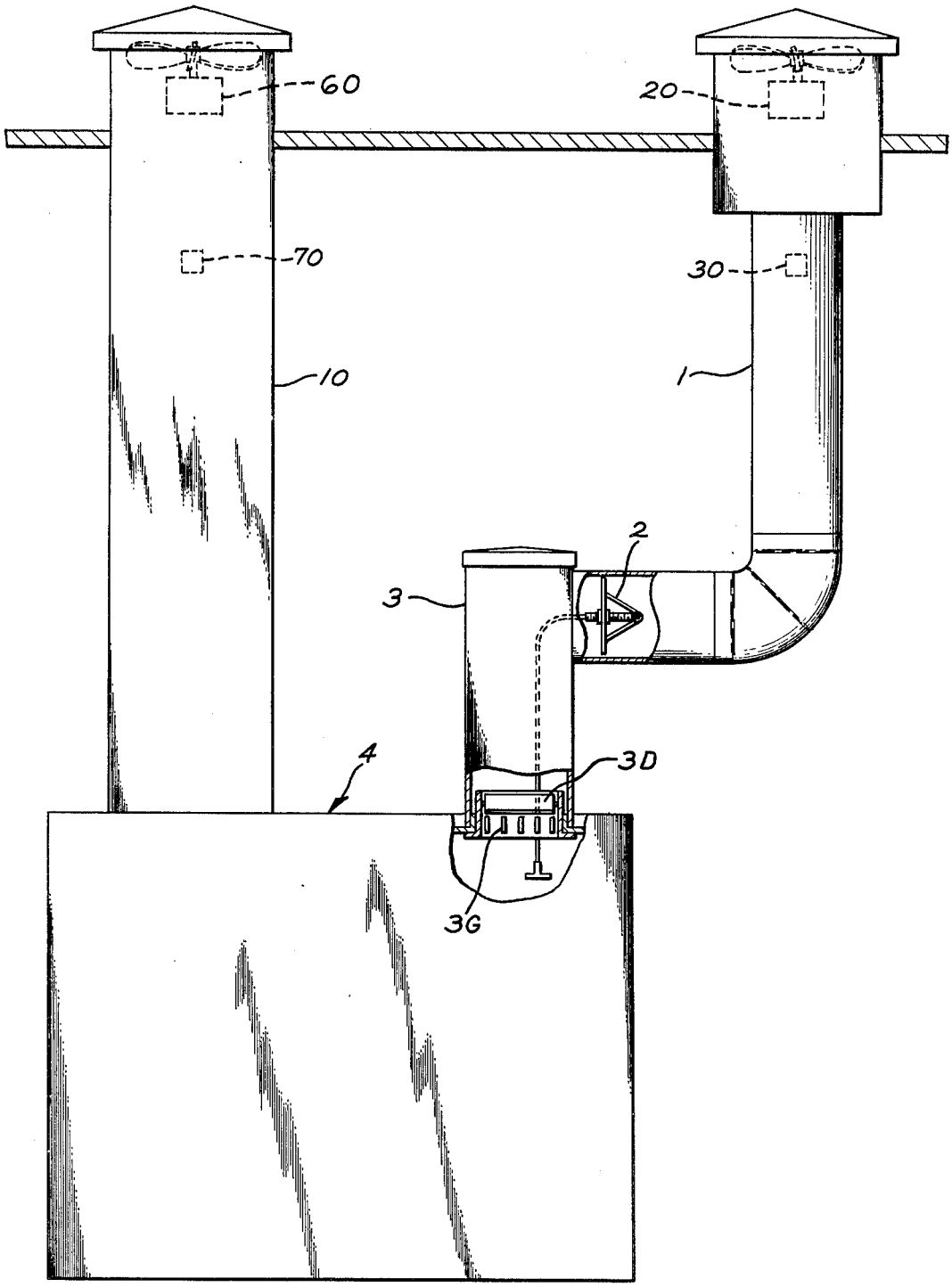
FIG. 5 is a view of the exhaust and intake systems illustrating the relationship of the pressure sensors to each of the exhaust and intake ducts.

As is indicated in FIG. 5, the supply sensor 30 is located in the supply duct 1 and thus indicates the static pressure in the supply line. As previously indicated, the velocity damper 2 in the supply duct 1 is set to balance the supply of intake air so that the static pressure of the intake duct is in balance with the static pressure of the exhaust duct.

Referring again to FIG. 4 for the exhaust system, the exhaust fan motor 60 is interconnected via lines 62 through fan relay 61. 62A indicates a neutral line completing the circuit. Control power lines 64 and 64A energize the exhaust fan relay 61. The pressure sensor 70 again contains a common terminal C, a normally open terminal NO. The power line 71A to sensor 70 is connected to transformer 40 via line 36. Line 71 running from common terminal C of pressure sensor 70 is connected to the indicator light 74.

In the installation of this system, the velocity damper 2 is set to regulate the static pressure of the system. The pressure sensors 30 and 70 are then manually set to balance and monitor the static pressure in the exhaust and supply ducts 10 and 1 respectively. Thus when the sensors become out of balance the appropriate light will go out indicating that one of the fans is not operating, that the filter member 7 is plugged or that some other disorder has happened. Thus the operator can take proper steps to call for service or to replace the filter or to do whatever is necessary to place the system back into operation. Of course it is possible to utilize buzzers or other indicating means in connection with the pressure sensors so as to indicate a disfunction of the system.

It should be obvious to those skilled in the art that there has been presented here a system which is easier and more economical to install initially due to the single wall intake plenum construction and which is additionally much cheaper to operate because of the tremendous energy savings. Many modifications will occur to those skilled in the art from the detailed description of the preferred embodiment which is meant to be exemplary in nature and non-limiting except so as to be commensurate in scope with the appended claims.

We claim:

1. A ventilation system for removing and filtering fumes in the space above a cooking surface, which comprises:

A. a hood of single wall non-plenum construction located above said cooking surface and covering a portion of the space above said cooking surface to form an entrainment chamber between said hood and said cooking surface which is generally coextensive with the area of said cooking surface and including an open front portion;

B. air intake means in operative relation with said hood and having an intake blower means for introducing air from the outside into the entrainment chamber;

C. air spreading and diffusion means in the top of said hood and in open communication with said air inlet means and said entrainment chamber for equalizing the volume of air delivered from said air intake means into the entrainment chamber and for spreading and diffusing said air across the horizontal plane of said entrainment chamber so as to conform generally with the area of the cooking surface;

D. exhaust means in operative relation with said hood and including 1. an exhaust duct, and
2. an exhaust blower means;

E. filter means situated between said hood and said exhaust duct;

F. the improvement of static regulating means to balance the static pressure of said intake means and said exhaust means; and G. pressure sensor means in said intake means and in said exhaust means for indicating an imbalance of static pressure.

2. A ventilation system, as defined in claim 1 of the improvement wherein said air intake means includes:

a. an inlet supply duct in communication with said inlet blower;

b. a supply plenum in open communication with said supply duct and the air spreading and diffusion means in the top of said hood.

3. A ventilation system, as defined in claim 1, the improvement wherein said air spreading and diffusion means comprises:

a. a diffusion grill extending across the top of the hood in a plane parallel to that of said cooking surface and having vanes extending downwardly toward said cooking surface.

4. A ventilating system, as defined in claim 1, the improvement wherein said air spreading and diffusing means comprises:

a. a diffusion damper having pairs of vanes extending downwardly in a diverging and spreading pattern toward said cooking surface.

5. A ventilation system, as defined in claim 1, in which said exhaust means comprises an exhaust chamber in communication with said hood and with said exhaust duct.

6. A ventilation system, as defined in claim 1, in which said filter means comprises:

a. a filter opening in the rear of the roof of said hood;

b. a filter frame defining the periphery of said filter opening, and c. a removable filter element mounted in said frame.

7. A ventilation system, as defined in claim 1, in which the said pressure regulator means comprises a velocity damper located in said air intake means.

8. A ventilating system, as defined in claim 1, in which said pressure sensor means are electrically interconnected with said blower means.

9. A ventilation system, as defined in claim 8, the further combination therewith of indicator means electrically interconnected with said pressure sensors.

10. A process of removing and filtering fumes from a cooking surface which comprises the steps of:

a. defining an entrainment chamber above said cooking surface;

b. blowing air from an air intake into said chamber and forming a diffuse air pattern corresponding with the area of said cooking surface and simultaneously mixing said air with the heated fumes from said cooking surface to form a heated gas mixture within the confines of said entrainment chamber;

c. passing said heated gas mixture through a filter and removing particular matter therefrom;

d. blowing said heated gas to an exhaust; and e. maintaining a balanced static pressure between the air intake and the exhaust.

* * * * *